US008485011B2

(12) United States Patent
Hastings et al.

(10) Patent No.: US 8,485,011 B2
(45) Date of Patent: Jul. 16, 2013

(54) TOOL FOR INSTALLING RIVET NUTS

(76) Inventors: John Kenneth Hastings, Worcestershire (GB); James William Ian Hastings, Worcestershire (GB)

( * ) Notice: Subject to any disclaimer, the term of this patent is extended or adjusted under 35 U.S.C. 154(b) by 144 days.

(21) Appl. No.: 13/032,132

(22) Filed: Feb. 22, 2011

(65) Prior Publication Data

US 2011/0203088 A1 Aug. 25, 2011

(30) Foreign Application Priority Data

Feb. 22, 2010 (GB) ..... 1002954.4

(51) Int. Cl.
*B21J 15/34* (2006.01)

(52) U.S. Cl.
USPC ..... 72/114; 72/391.8; 29/243.526

(58) Field of Classification Search
USPC ..... 72/114, 391.8; 29/243.526
See application file for complete search history.

(56) References Cited

U.S. PATENT DOCUMENTS

| | | | | |
|---|---|---|---|---|
| 3,587,271 | A * | 6/1971 | Rigot | 72/114 |
| 4,121,444 | A * | 10/1978 | Duran | 72/114 |
| 4,400,960 | A * | 8/1983 | Martin | 72/114 |
| 4,402,203 | A * | 9/1983 | Molina | 72/114 |
| 6,029,332 | A * | 2/2000 | Schruff | 72/391.8 |
| 7,237,413 | B2 * | 7/2007 | Monahan et al. | 29/243.526 |

FOREIGN PATENT DOCUMENTS

| | | |
|---|---|---|
| DE | 20 09 428 | 10/1970 |
| DE | 27 48 093 | 10/1978 |
| DE | 92 07 634 | 8/1992 |
| EP | 0 730 839 | 9/1996 |
| GB | 2 185 705 | 1/1986 |
| WO | 89/10238 | 11/1989 |
| WO | 2010/146018 | 12/2010 |

OTHER PUBLICATIONS

Intellectual Property Office Search Report for corresponding application No. GB1102827.1 dated Apr. 20, 2011.

European Search Report for corresponding patent application No. EP 11 00 1334 dated Nov. 6, 2012.

* cited by examiner

*Primary Examiner* — David B Jones

(74) *Attorney, Agent, or Firm* — Renner, Otto, Boisselle & Sklar, LLP

(57) ABSTRACT

A tool for installing rivet nuts, the tool comprising a screw, a rotatable drive for rotating the screw and an anti-rotation device for preventing rotation of a rivet nut which has been screwed onto the screw.

24 Claims, 5 Drawing Sheets

TOOL FOR INSTALLING RIVET NUTS

RELATED APPLICATION DATA

This application claims priority to United Kingdom Patent Application No. 1002954.4 filed on Feb. 22, 2010, which is hereby incorporated herein by reference.

FIELD OF THE INVENTION

The invention relates to a tool for installing rivet nuts.

BACKGROUND

A rivet nut is a blind nut comprising a flange and internally threaded body. Rivet nuts are installed by inserting them into a pre-drilled hole. The nut is then deformed by compressing it until the rivet nut is held tight in the hole and will not turn.

Rivet nuts may be installed using a hand tool.

Most hand tools currently being manufactured and sold throughout the world use a linear action to compress the rivet nut. Tools take the form of either a hand plier, where two handles are gripped and pulled together to directly compress the rivet nut, or a lever tool, where two handles are pulled together and the rivet nut is compressed using an action similar to that of a set of garden shears.

Both types of tool have many disadvantages in terms of quality, reliability, difficulty of access, the need to accurately set the stroke (or movement) of the tool to obtain the correct installation of the rivet nut, difficulty of use, and the requirement for two hands and a lot of strength to operate the tool.

A small number of hand tools use a rotary action to compress the rivet nut. These have the advantage that they require less force to be operated than the tools which use a linear action. However, the known tools are complicated and therefore expensive to manufacture.

SUMMARY OF THE INVENTION

The present invention seeks to provide a tool for installing rivet nuts which uses a rotary action, but is simple, cheap to manufacture and of high quality.

Accordingly, the invention provides a tool for installing rivet nuts, the tool comprising a screw, a rotatable drive means for rotating the screw and means for preventing rotation of a rivet nut which has been screwed onto the screw.

As the tool includes means for preventing rotation of a rivet nut which has been screwed onto the screw, rotating the drive means will result in the rivet nut being compressed.

The screw may be a set screw or cap screw. In particular, it may be a conventional high tensile set screw or cap screw. Such screws are readily attainable from any hardware store.

The tool may be provided with a plurality of screws having different thread sizes. Usually it will be sufficient to provide screws having thread sizes from M4 to M8 inclusive as this will cover about 85 to 90% of market demand, but an M10 variant may also be provided.

The tool may comprise a body having an end face with a through hole for receiving the screw.

The outer surface of the end face may be roughened, for example by grit blasting. Roughening the end surface of the body means that it can provide a key to prevent rotation of a rivet nut which has been screwed onto the screw.

The body may be hollow and the drive means may be dimensioned to be a running fit with the bore of the body. The term "running fit" as used herein means that the drive means is free to rotate within the bore of the body.

The tool may comprise means to hold the drive means within the body.

The holding means may comprise a handle which comprises a projection. Alternatively, the holding means may comprise a first washer. The drive means may comprise a recess to receive the projection or first washer.

The bore of the body may comprise a recess around its circumference to receive the first washer.

The tool may further comprise a rotatable screw holder which comprises means for holding the screw and is dimensioned to be a running fit with the bore of the body.

The tool may further comprise means to hold the screw holder within the body.

The holding means may comprise a second washer.

The screw holder may comprise a recess around its outer circumference to receive the second washer.

The bore of the body may comprise a recess around its circumference to receive the second washer.

Alternatively, the holding means may comprise a retractable element which can be moved between a first position in which it does not hold the screw holder in place and a second position in which it does hold the screw holder in place.

The screw holder may comprise a recess to receive the retractable element.

The retractable element may be a screw located in an aperture in the body.

In use, the drive member may be engaged with the screw holder.

The screw holder and the drive member may be a push fit with one another. The screw may be held within the screw holder by a grommet.

The tool may further comprise means for facilitating rotation of the drive member and/or screw holder.

The rotation-facilitating means may comprise a bearing set.

The drive means may be rotatable by hand.

The invention further provides a kit of parts for assembling a tool according to the invention, the kit of parts comprising a plurality of elements each comprising a screw, each screw being of different thread size, and a drive means which can be used with any of the elements.

Each of the elements may further comprise a body and a screw holder.

BRIEF DESCRIPTION OF THE DRAWINGS

The invention will now be illustrated by way of example with reference to the following drawings (it is noted that some features shown some figures are omitted in other figures and some features shown in some figures are shown in greater detail in other figures) of which.

DETAILED DESCRIPTION

Figure 1:
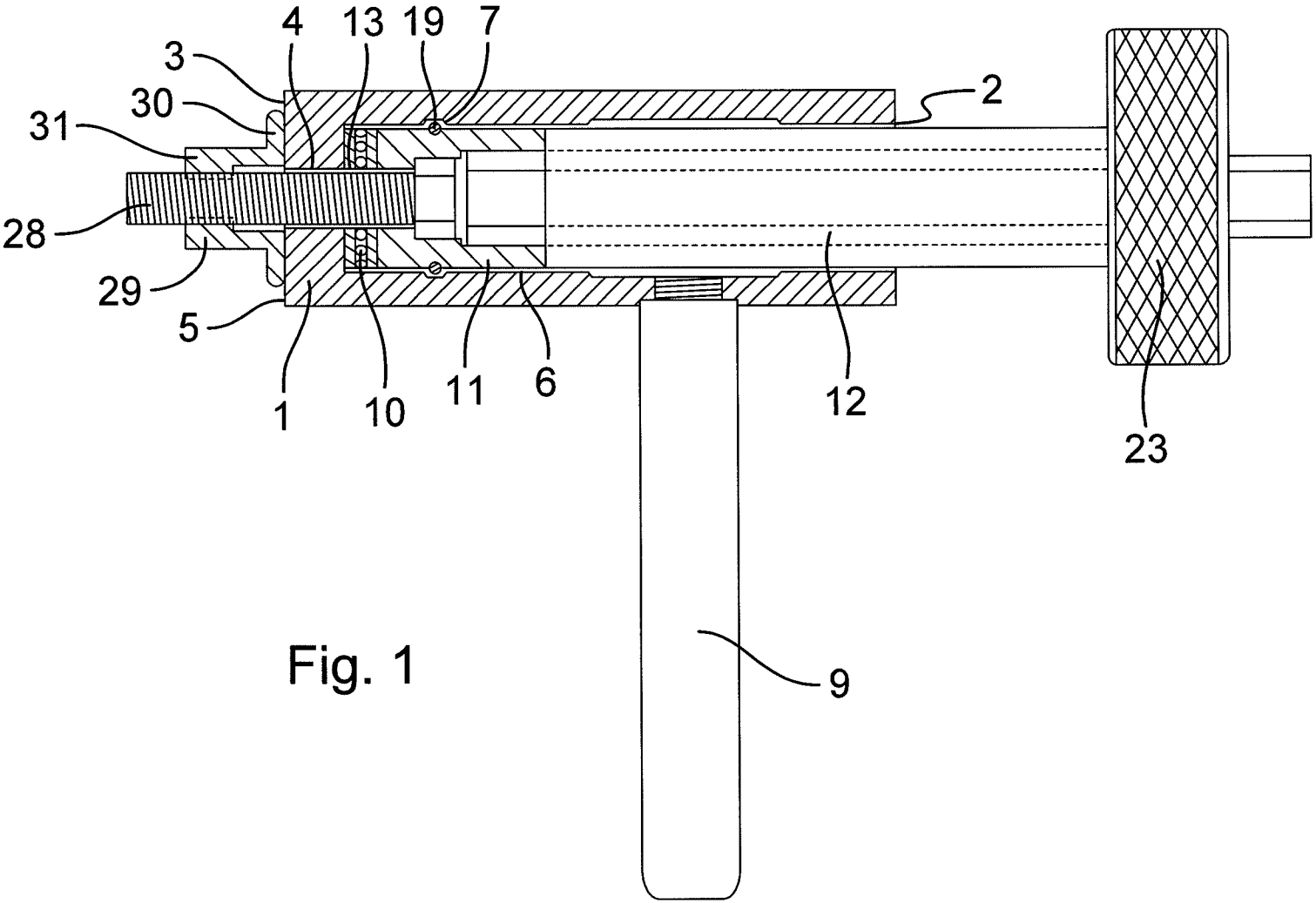
FIG. 1 shows a cross-sectional side view of a first embodiment of a tool according to the invention.

The tool shown in FIG. 1 comprises a hollow cylindrical body 1 having an open end face 2 and a closed end face 3, which is provided with a through hole 4. The outer surface 5 of the closed end face 3 has been roughened by grit blasting and then case hardened.

The bore 6 of the body 1 is provided with a recessed groove 7 about its circumference, positioned towards the closed end face 3 of the body 1.

The outer surface of the body 1 is provided with a threaded aperture 8 for receiving a removable handle 9, positioned towards the open end face 2 of the body 1.

Fitted within the bore 6 of the body 1, adjacent to one another, starting with the member adjacent to the closed end face 3, are a bearing set 10, a screw holder 11 and a drive member 12.

The bearing set 10 is cylindrical and is provided with a through hole 13. The bearing set 10 which comprises one needle bearing sandwiched between two hardened thrust washers.

The screw holder 11 comprises a hollow cylindrical body 14 having an open end face 15 and a closed end face 16, which is provided with a through hole 17. The body 14 is dimensioned to be a running fit with the surface of the bore 6 of the body 1 of the tool.

The screw holder 11 includes a recessed groove 18 about its outer circumference. The screw holder 11 is retained within the body 1 of the tool by an "O" ring 19 which is fitted in the groove 18. The screw holder may comprise a rubber grommet (not shown) located above the screw head to maintain that screw within the screw holder.

The drive member 12 comprises a cylindrical body 20 having a recessed and elongated groove 21 around its outer circumference. The body 20 is dimensioned to be a running fit with the surface of the bore 6 of the body 1 of the tool. The drive member 12 is retained within the body 1 of the tool by a nipple 22 located on the end of handle 9, which is fitted within groove 21 on the drive member 12. In an alternative embodiment (not shown), the drive member is retained within the body of the tool by an "O" ring, which is fitted within a recessed groove in the drive member.

A knurled knob 23 is removably attached to one end of the body 20 and a drive element 24 is provided at the other end of the body 20. The drive element 24 comprises two sections 25, 26, a first section 25 which comprises a hexagonal body of smaller cross section than the body of the drive member 12, and a nipple 26. The nipple 26 acts to locate the grommet above the screw head. The bore 27 of the body 14 of the screw holder 11 is dimensioned so that it is a push fit with the first section 25 of the drive element 24 of the drive member 12.

The tool further comprises a set screw 28, which has a hexagonal head (not shown) at one end. The set screw is a high tensile grade 8.8 or 10.9 strength set screw.

The through holes 4, 13, 17 in the body 6 of the tool, bearing set 10, screw holder 11 and the drive element 24 are aligned with one another. The set screw 28 is positioned within the tool so that it passes through the aligned through holes 4, 13, 17 and the first section 25 of the drive element 24 is received in the end of screw holder 11.

In order to install a rivet nut 29, the rivet nut is screwed onto the set screw 28 and hand tightened until the head 30 of the rivet nut 29 is tight against the closed end face 3 of the body 1. The knob 23 is then rotated clockwise. Because the end face 3 has been roughened it provides a key which prevents the rivet nut 29 from rotating when the knob 23 is rotated. This means that rotating the knob 23 causes the set screw 28 to rotate and compress the rivet nut 29. Once the rivet nut has been installed, the knob 23 is rotated counter-clockwise to release the set screw 28 from the installed rivet nut.

For most rivet nuts 29, it will be possible to turn the knob 23 by hand, but for larger sizes of steel or stainless steel rivet nuts, it may be necessary to use a ratchet spanner to turn the drive member 12.

The tool of FIG. 1 may be provided in the form of a kit of parts which may be used to install rivet nuts having a range of different thread sizes. The kit of parts shown in FIG. 5 comprises a single handle 32 and drive member 33 and a number of elements 34 each comprising a body 35 together with a screw holder (not shown), bearing set (not shown) and set screw 36, each of the set screws 36 having a different thread size. Usually it will be sufficient to provide set screws 36 having thread sizes from M4 to M8 inclusive as this will cover around 85 to 90% of market demand.

Figure 5:
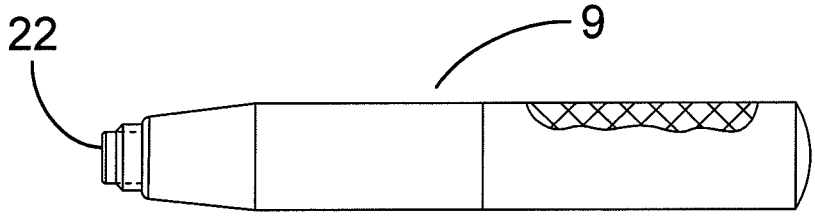
FIG. 5 shows a side view of the handle of the tool shown in FIG. 1.
Figure 6:
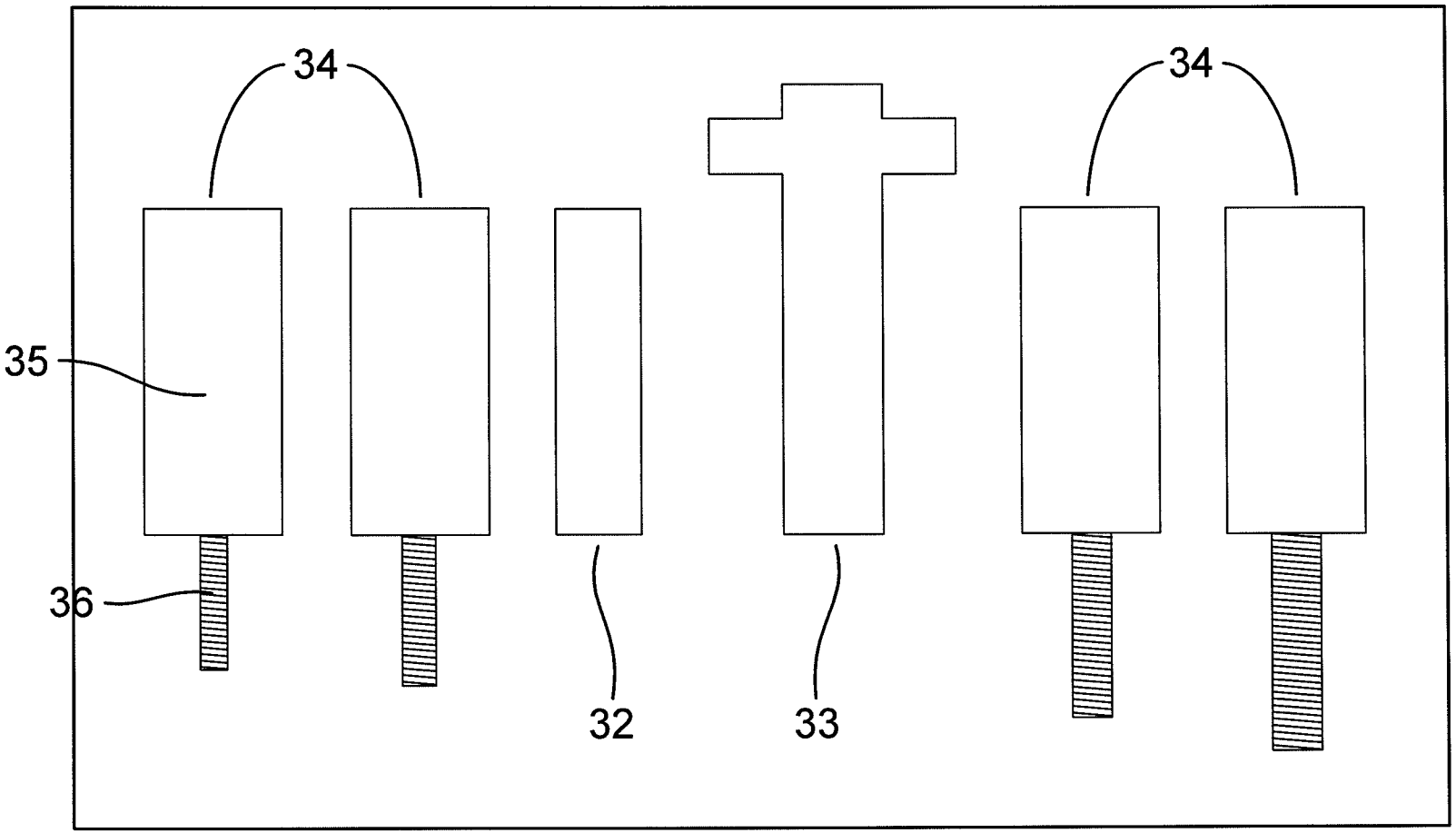
FIG. 6 shows a tool case containing a kit of parts for assembly into a tool according to the invention.
Figure 7:
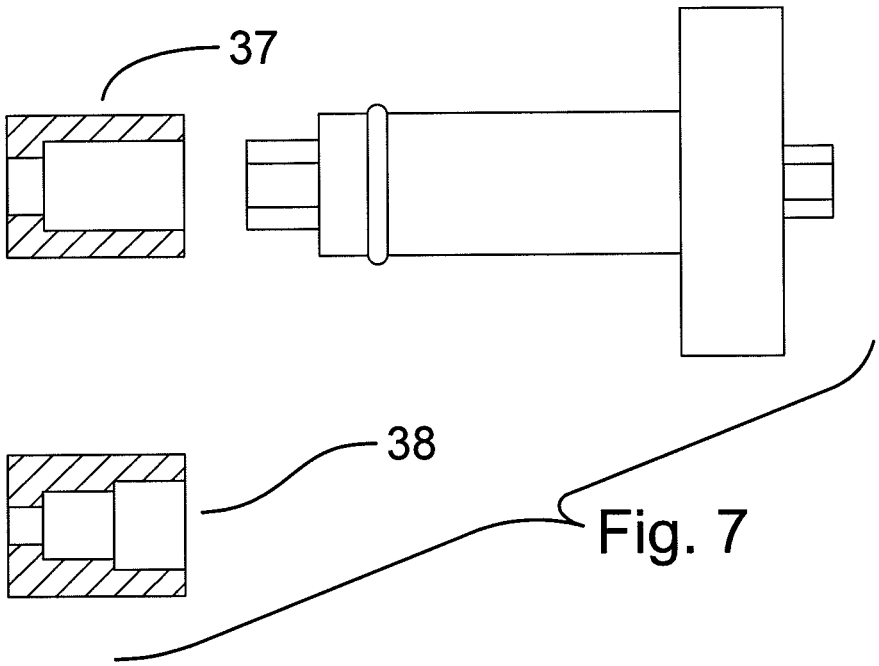
FIG. 7 shows a side cross-sectional view of two alternative screw holders.

FIG. 6 shows two different types of screw holder 37, 38 for use in the kit of FIG. 5. Screw holder 37 is suitable for use with an M8 set screw and screw holder 38 is suitable for use with M4-M6 set screws, being drilled and broached to the appropriate size.

In order to assemble the tool, the desired set screw 36 is selected, and the handle 32 is screwed into the body 35 of the element 34 which contains that set screw 36. The drive member 33 is then inserted into the open end of the body 35 and pushed into the body 35 until the first section of the drive member 33 is fully inserted in the recess of the screw holder.

Figure 8:
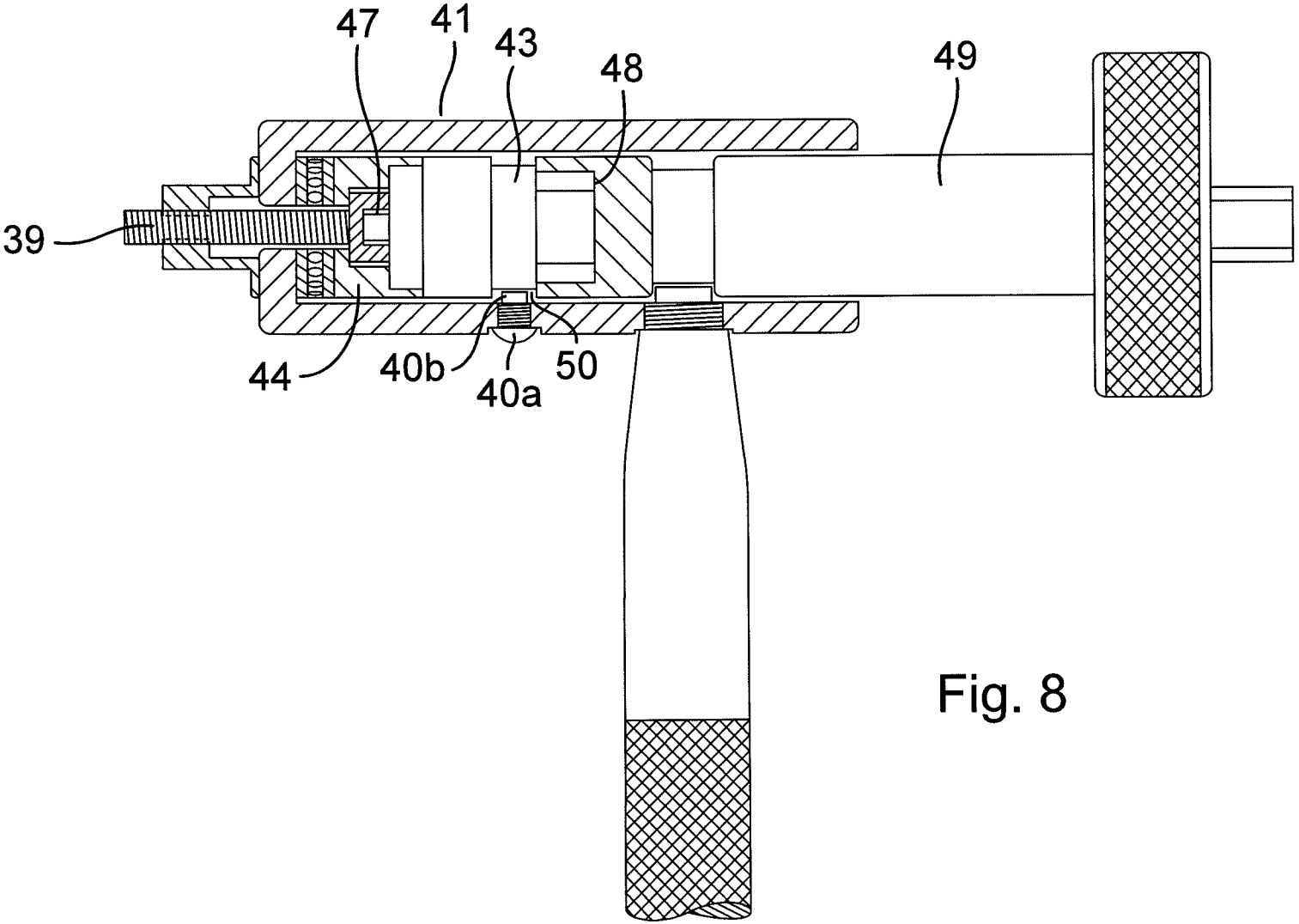
FIG. 8 shows a cross-sectional side view of a second embodiment of a tool according to the invention.

The tool shown in FIG. 8 is similar to the tool shown in FIG. 1, but there are two main differences.

The first main difference is that the hexagonal head set screw 28 has been replaced by a socket head cap screw 39. Such cap screws are readily available as a standard product in grade 12.9 anywhere in the world in any quantity. This means that the tool shown in FIG. 8 is suitable for use in any countries where it may be difficult to obtain hexagonal head set screws in the higher strength grades.

The second main difference is that the "O" ring 19 which holds the screw holder 11 in place in the body 1 has been replaced by a button head socket cap screw 40*a*, thereby eliminating the need for the internal recessed groove in the body. The button head socket cap screw 40*a* has a dog point 40*b*.

Figure 2:
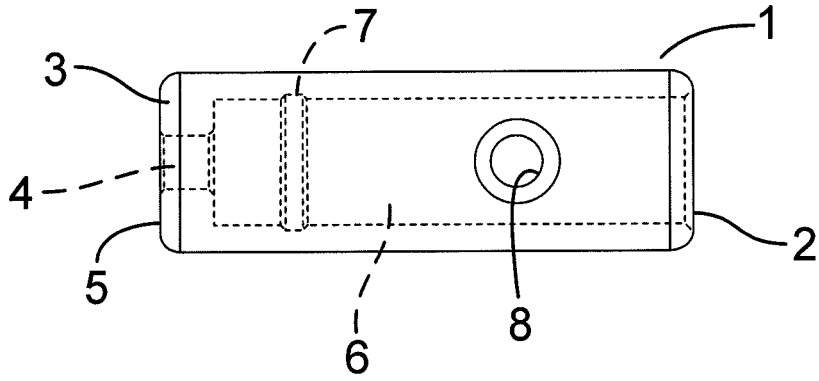
FIG. 2 shows a side view of the body of the tool shown in FIG. 1.
Figure 3:
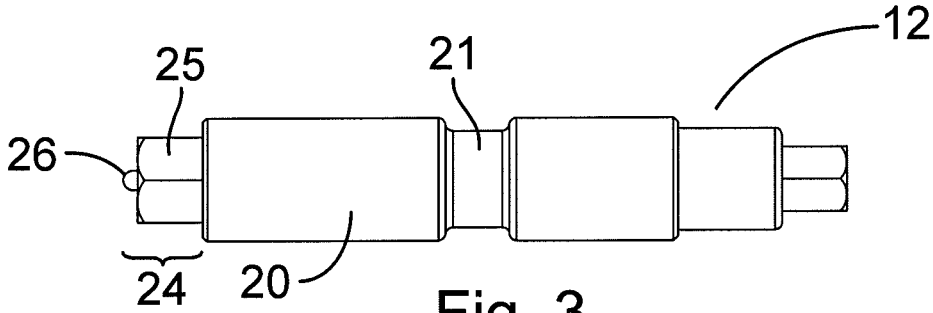
FIG. 3 shows a side view of the drive member of the tool shown in FIG. 1.
Figure 4A:
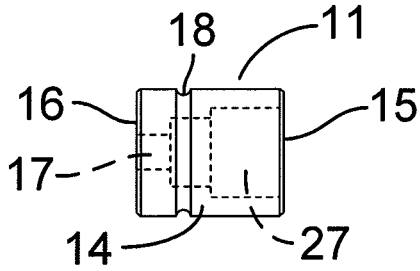
FIG. 4*a* shows a side view of the screw holder of the tool shown in FIG. 1.
Figure 4B:
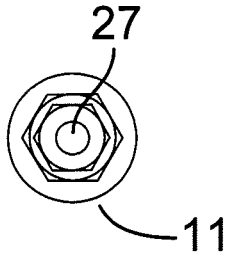
FIG. 4*b* shows an end view of the screw holder of the tool shown in FIG. 1.
Figure 9:
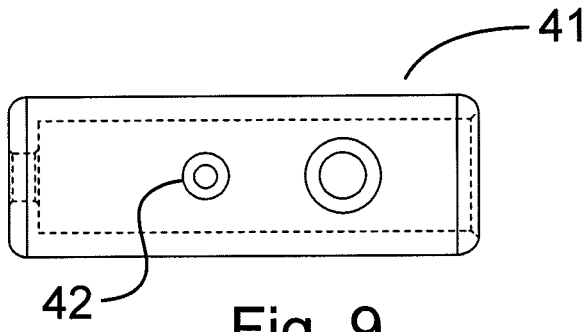
FIG. 9 shows a side view of the body of the tool shown in FIG. 8.

The body 41 of the tool of FIG. 8 is shown in FIG. 9. It can be seen that, unlike the body 1 of FIG. 2, it does not include an internal recessed groove 7. Instead, it includes a screw-threaded aperture 42. The button head socket cap screw 40*a* is located in this screw-threaded aperture 42 so that it can be moved between a first position in which it does not hold the screw holder 43 in place and a second position in which it does hold the screw holder 43 in place.

Figure 10:
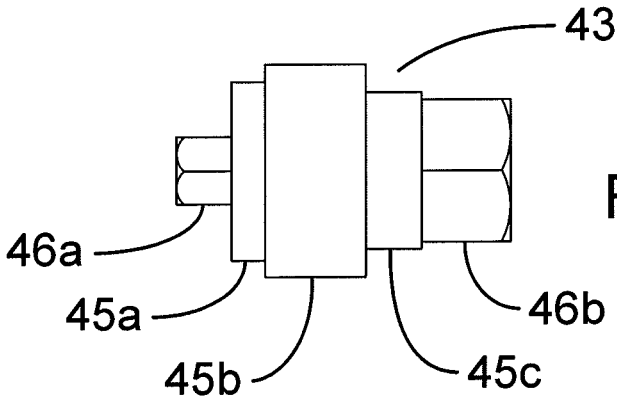
FIG. 10 shows a side view of the screw holder of the tool shown in FIG. 8.

The screw holder 43 of the tool of FIG. 8 is shown in FIG. 10. The screw holder 43 is located within the body 41 by the support washer 44 shown in FIG. 8. It can be seen that the screw holder 43 comprises three adjoining cylindrical sections 45*a*, 45*b*, 45*c* of different cross-section, and two hexagonal bosses 46*a*, 46*b* of different cross-section, one at either end of the three sections 45*a-c*.

The first hexagonal boss 46*a* is dimensioned so that it is a push fit in a recess 47 in one end of the socket head cap screw

39. The second hexagonal boss 46*b* is dimensioned so that it is a push fit in a recess 48 in one end of the drive member 49. The second section 45*b* has the largest cross-section of the three sections 45*a-c*, and is dimensioned to be a running fit with the surface of the bore of the body 41 of the tool. The third section 45*c* is positioned between the second section 45*b* and the second hexagonal boss 46*b*. When the tool is assembled, this section 45*c*, having a smaller cross-section than the second section 45*b*, acts to provide a recess 50 in which the button head socket cap screw 40*a* can locate, thereby holding the screw holder 43 in place.

The tool of FIG. 8 may be provided in the form of a kit similar to that shown in FIG. 5.

The above embodiments are described to illustrate the invention, and are not intended to be limiting. The skilled person will be readily able to devise alternative embodiments without departing from the scope of the claims.

What is claimed is:

1. A tool for installing rivet nuts, the tool comprising a screw, a body having an end face with a through hole for receiving the screw, a rotatable drive means for rotating the screw, means for preventing rotation of a rivet nut which has been screwed onto the screw, and means to hold the drive means within the body, wherein the holding means comprises a handle which comprises a projection.

2. A tool according to claim 1, wherein the screw is a set screw or a cap screw.

3. A tool according to claim 1, wherein the tool is provided with a plurality of screws having different thread sizes.

4. A tool according to claim 1, wherein the tool further comprises a body having an end face with a through hole for receiving the screw.

5. A tool according to claim 4, wherein the outer surface of the end face is roughened.

6. A tool according to claim 4, wherein the body is hollow and the drive means is dimensioned to be a running fit with the bore of the body.

7. A tool according to claim 1, wherein the drive means comprises a recess to receive the holding means.

8. A tool according to claim 1, wherein the tool further comprises a rotatable screw holder which comprises means for holding the screw and is dimensioned to be a running fit with the bore of the body.

9. A tool according to claim 8, wherein the tool further comprises means to hold the screw holder within the body.

10. A tool according to claim 8, wherein, in use, the drive member is engaged with the screw holder.

11. A tool according to claim 10, wherein the screw holder and the drive member are a push fit with one another.

12. A tool according to claim 1, wherein the drive means is rotatable by hand.

13. A kit of parts for assembling a tool according to claim 1, the kit of parts comprising a plurality of elements each comprising a screw, each screw being of a different thread size, and a drive means which can be used with any of the elements.

14. A kit of parts according to claim 13, wherein each of the elements further comprises a body and a screw holder.

15. A tool for installing rivet nuts, the tool comprising a screw, a body having an end face with a through hole for receiving the screw, a rotatable drive means for rotating the screw, means for preventing rotation of a rivet nut which has been screwed onto the screw, and means to hold the drive means within the body, wherein the holding means comprises a first washer.

16. A tool according to claim 15, wherein the bore of the body comprises a recess around its circumference to receive the first washer.

17. A tool for installing rivet nuts, the tool comprising a screw, a rotatable drive means for rotating the screw, means for preventing rotation of a rivet nut which has been screwed onto the screw, a body having an end face with a through hole for receiving the screw, a rotatable screw holder which comprises means for holding the screw and is dimensioned to be a running fit with the bore of the body, and means to hold the screw holder within the body, wherein the holding means comprises a second washer.

18. A tool according to claim 17, wherein the screw holder comprises a recess around its outer circumference to receive the second washer.

19. A tool according to claim 17, wherein the bore of the body comprises a recess around its circumference to receive the second washer.

20. A tool for installing rivet nuts, the tool comprising a screw, a rotatable drive means for rotating the screw, means for preventing rotation of a rivet nut which has been screwed onto the screw, a body having an end face with a through hole for receiving the screw, a rotatable screw holder which comprises means for holding the screw and is dimensioned to be a running fit with the bore of the body, and means to hold the screw holder within the body, wherein the holding means comprises a retractable element which can be moved between a first position in which it does not hold the screw holder in place and a second position in which it does hold the screw holder in place, and, wherein the retractable element is a screw located in an aperture in the body.

21. A tool for installing rivet nuts, the tool comprising a screw, a rotatable drive means for rotating the screw, means for preventing rotation of a rivet nut which has been screwed onto the screw, a body having an end face with a through hole for receiving the screw, and a rotatable screw holder which comprises means for holding the screw and is dimensioned to be a running fit with the bore of the body, and wherein the screw is held within the screw holder by a grommet.

22. A tool according to claim 21, wherein the tool comprises means to hold the drive means within the body.

23. A tool according to claim 21, wherein the tool further comprises means for facilitating rotation of the drive member and/or screw holder.

24. A tool according to claim 23, wherein the rotation-facilitating means comprises a bearing set.

* * * * *